US010166649B2

(12) United States Patent
Yasuda et al.

(10) Patent No.: US 10,166,649 B2
(45) Date of Patent: Jan. 1, 2019

(54) MACHINING APPARATUS FOR WORKPIECE

(71) Applicant: SHIN-ETSU HANDOTAI CO., LTD., Tokyo (JP)

(72) Inventors: Taichi Yasuda, Kita-ku (JP); Tatsuo Enomoto, Setagaya-ku (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 86 days.

(21) Appl. No.: 15/523,817

(22) PCT Filed: Oct. 21, 2015

(86) PCT No.: PCT/JP2015/005308
§ 371 (c)(1),
(2) Date: May 2, 2017

(87) PCT Pub. No.: WO2016/079923
PCT Pub. Date: May 26, 2016

(65) Prior Publication Data

US 2017/0312878 A1 Nov. 2, 2017

(30) Foreign Application Priority Data

Nov. 18, 2014 (JP) ..... 2014-233585

(51) Int. Cl.
*B24B 37/08* (2012.01)
*B24B 37/005* (2012.01)
(Continued)

(52) U.S. Cl.
CPC ..... *B24B 37/005* (2013.01); *B24B 37/08* (2013.01); *B24B 37/34* (2013.01); *B24B 49/10* (2013.01)

(58) Field of Classification Search
CPC ..... B24B 7/22; B24B 37/005; B24B 37/08
(Continued)

(56) References Cited

U.S. PATENT DOCUMENTS 6,354,907 B1 * 3/2002 Satoh ..... B24B 37/005 451/10
6,634,924 B1 * 10/2003 Ono ..... B24B 37/0053 451/287
(Continued)

FOREIGN PATENT DOCUMENTS

JP H02-106269 A 4/1990
JP 2005-243996 A 9/2005
(Continued)

OTHER PUBLICATIONS

Nov. 24, 2015 Search Report issued in International Patent Application No. PCT/JP2015/005308.

*Primary Examiner* — Robert Rose
(74) *Attorney, Agent, or Firm* — Oliff PLC

(57) ABSTRACT

A machining apparatus for a workpieces includes an upper turn table support mechanism supporting an upper turn table from above to be vertically movable by a cylinder extending along a rotational axis direction of the table, a horizontal plate fixed to the cylinder so that a main surface thereof becomes perpendicular to a longitudinal axis of the cylinder, at least three displacement sensors which measure horizontal plate surface height positions when the upper turn table has moved down to a fixed position, and a control apparatus to calculate a relative upper turn table height position and an angle formed between the upper turn table rotational axis and the cylinder longitudinal axis from the horizontal plate surface height positions measured by the displacement sensors. A workpiece holding abnormality can be accurately and quickly detected before machining the workpiece to
(Continued)

avoid damage, and an cylinder eccentric angle can be detected during machining.

10 Claims, 6 Drawing Sheets

(51) Int. Cl.
*B24B 37/34* (2012.01)
*B24B 49/10* (2006.01)

(58) Field of Classification Search
USPC ..... 451/288, 289, 290, 287, 5, 41
See application file for complete search history.

(56) References Cited

U.S. PATENT DOCUMENTS

2008/0070479 A1* 3/2008 Nabeya ..... B24B 37/30
451/8
2014/0320867 A1* 10/2014 Kanno ..... B24B 37/013
356/630
2016/0332279 A1* 11/2016 Yasuda ..... B24B 37/042

FOREIGN PATENT DOCUMENTS

JP 2008-036802 A 2/2008
JP 2013-078826 A 5/2013

* cited by examiner

MACHINING APPARATUS FOR WORKPIECE

TECHNICAL FIELD

The present invention relates to a machining apparatus for a workpiece, e.g., a double-side polishing apparatus or a double-side lapping apparatus which inserts a workpiece into a holding hole of a carrier, holds the workpiece, and simultaneously machine both sides of the workpiece.

BACKGROUND ART

In case of flattening a thin-plate workpiece such as a silicon wafer, a double-side polishing apparatus or a double-side lapping apparatus has been conventionally used. For example, in the double-side polishing apparatus, a discoid carrier having a planetary gear at an outer peripheral portion thereof is arranged between upper and lower turn tables having polishing pads made of urethane foam or nonwoven fabrics attached thereto. A workpiece is held in a holding hole of this carrier, a sun gear and an internal gear which mesh with the planetary gear are mutually rotated, and a rotational movement of the carrier or an orbital motion of the same around the sun gear is thereby caused. The rotational and orbital motions of this carrier and the rotation of the upper and lower turn tables cause the workplace and the upper and lower turn tables to slide, thereby simultaneously polishing upper and lower surfaces of the workpiece. During the polishing, to efficiently perform the polishing, polishing slurry is supplied from a plurality of holes provided in the upper turn table.

The upper turn table can move up and down, and the carrier can be arranged thereon at an ascending position, or the workpiece is held in the carrier at this position. After the workpiece is held, the upper turn table moves down so that the workpiece and the carrier are sandwiched between the upper and lower turn tables. The workpiece is manually held by an operator or held by using an automatic handling apparatus depending on situations (see, e.g., Patent Literature 1).

The upper turn table is moved up and down by an upper turn table support mechanism which supports the upper turn table from above. The upper turn table support mechanism includes a cylinder having a shaft which can move an and down, and the shaft of the cylinder is coupled with the upper turn table through a connecting section. For example, a universal joint or a spherical bearing is used for this connecting section. That is because, when a thickness of the workpiece to be polished or the carrier varies, a degree of freedom is imparted to an inclination of the upper turn table during the polishing so that a load can be assuredly transmitted to the workpiece.

CITATION LIST

Patent Literature

Patent Literature 1: Japanese Unexamined Patent Publication (Kokai) No. 2005-243996

DISCLOSURE OF INVENTION

Problem to be Solved by the Invention

When the workpiece is polished in a state where the workpiece held by the carrier is not correctly accommodated in the holding hole of the carrier, i.e., a state where the workpiece is abnormally held, the workpiece largely protrudes from the holding hole, and the workpieces is damaged. In this case, not only the workpiece protruding from the carrier is damaged, but also other workpieces or the carrier may be highly possibly damaged in a chain reaction. Further, the rears, the polishing pads, and the turn tables of the apparatus may be damaged in some situations.

Consequently, a yield rate is decreased due to the damage to the workpiece, productivity is lowered due to a machining apparatus recovery work, and costs are Increased due to replacement of damaged apparatus components or the polishing pads.

As causes of the workpiece abnormality, there are a case where the workpiece is not correctly inserted into the holding hole from the beginning, a case where the workpiece has been correctly inserted into the holding hole but provides from the holding hole due to, e.g., rotation of the turn tables before start of the polishing, and the like. It can be considered that such holding abnormalities are caused by simple operational errors when the workpiece is manually held by an operator or caused by insufficient functions of the apparatus due to a failure or the like when the automatic handling apparatus is used for holding like Patent Literature 1.

The following reasons for protrusion of the workpiece, which has been correctly inserted into the holding hole, from the holding hole before start of the polishing can be considered.

The workpiece obtains buoyancy by water or slurry staying in the holding hole of the carrier placed on the lower turn table, and hence it is apt to protrude. More specifically, in a general double-side polishing apparatus or double-side lapping apparatus, one carrier can hold one or more workpieces, and a plurality of carriers, e.g., five carriers are provided at equal intervals, i.e., intervals of 72° in the apparatus in most cases. At the time of holding the workpiece in the carrier, a target carrier in the plurality of carriers is moved to a specific workpiece loading position by rotating the internal gear and the sun gear. The operator manually puts the workpiece to be held by the carrier arranged in this specific loading position, or the automatic handling apparatus puts it to be held by the same. After holding of a wafer by the carrier placed at this specific loading position is finished, when the internal gear and the sun gear are rotated 72° in the same direction, an immediately adjacent carrier is then moved to the loading position for the workpiece (this operation may be called indexing of the carrier). Repeating the holding of the workpieces and indexing for five times enables all the five carriers to held the workpieces. Under conditions where the workpiece obtains the buoyancy and is hence apt to protrude, there is a possibility that the workpiece protrudes from the carrier when the carrier is moved like indexing or rotated.

For example, in a manufacturing process of a workpiece such as silicon wafer, a double-side lapping step or a double-side polishing step plays an important role of adjusting a thickness or flatness of the workpiece. In particular, a demand for the flatness is getting severe together with miniaturization of a semiconductor device, and a level of importance is increasing year by year.

To provide the excellent flatness or to further improve the flatness, a load must be uniformly applied to all workplaces. To realize this, the lower turn table must be adjusted to a horizontal state, the upper turn table must be rotated while being maintained in the horizontal state with respect to the carrier arranged thereon or the workpiece held by the carrier.

Thus, in addition to a machine accuracy such as a component accuracy or an assembling accuracy, an adjustment to match a central position of the upper turn table or a center of the cylinder with a rotational axis of the upper turn table must be assuredly performed.

However, in an actual operation, there are factors Which inhibit rotating the upper turn table while maintaining it in the horizontal state. As such factors, there are a deviation of the center of the cylinder from the rotational axis of the upper turn table or degradation of the machine accuracy with time described below.

A hook is disposed to the upper turn table, and this hook is inserted into a groove provided in a center drum when the upper turn table has moved down to a position where machining is carried out. Consequently, the center drum rotates, and the upper turn table can thereby rotate. The upper turn table moves up from the machining position at the time of loading or unloading the workpieces or the carriers or of cleaning or replacing the polishing pads. At this time, the hook moves out from the groove of the center drum. As described above, in a continuous operation, the insertion of the hook into the grove is repeated. There is a possibility that the adjusted center of the cylinder deviates due to this operation and a mechanical operation during the polishing or the like.

Further, when the workpiece or the carrier is damaged during the polishing, a considerable load is applied to various positions in the apparatus, and the machine accuracy is highly possibly degraded. In an actual operation, it is general for the excellently adjusted machine accuracy to degrade with time as described above.

In particular, in a machining apparatus having a cylinder coupled with an upper turn table through a universal joint or a spherical bearing, the deviation of the center of the cylinder or the degradation of the machine accuracy of the apparatus often occurs as an event that an angle formed between the rotational axis of the upper turn table and a longitudinal axis of the cylinder (which may be referred to as an eccentric angle of the cylinder hereinafter) increases.

However, since the degradation of the machine accuracy or the deviation of the center of the cylinder described above is hard to detect unless the operation is stopped, frequently performing such readjustments is difficult in terms of productivity. Thus, when the quality of the workpiece has varied due to such an aged change, it is difficult to grasp its cause on an earlier stage and take a countermeasure.

In view of the above-described problem, it is an object of the present invention to provide at low costs a machining apparatus which can accurately detect a workpiece holding abnormality in a short time before machining a workpiece to prevent damage to the workpiece or the machining apparatus and can detect an apparatus abnormality such as a deviation of a center of a cylinder during machining of the workpiece to suppress degradation of the quality of the workpiece.

Means for Solving Problem

To achieve the object, according to the present invention, there is provided a machining apparatus for a workpiece which inserts a workpiece into a holding hole of a carrier arranged on a lower turn table, holds the workpiece, moves down an upper turn table to a fixed position to sandwich the carrier holding the workpiece between the upper turn table and the lower turn table, and simultaneously machines both sides of the workpiece while rotating the upper turn table and the lower turn table around a rotational axis, respectively, the apparatus comprising: an upper turn table support mechanism which supports the upper turn table from above to be vertically movable by a cylinder extending along a rotational axis direction of the upper turn table; a horizontal plate fixed to the cylinder so that a main surface thereof becomes perpendicular to a longitudinal axis of the cylinder; at least three displacement sensors which measure height positions of a surface of the horizontal plate when the upper turn table has moved down to the fixed position; and a control apparatus configured to calculate a relative height position of the upper turn table and an angle formed between the rotational axis of the upper turn table and the longitudinal axis of the cylinder from the height positions of the surface of the horizontal late measured by the displacement sensors.

According to such a machining apparatus for a workpiece, a workpiece holding abnormality can be accurately detected in a short time before machining the workpiece on the basis of a calculated relative height position of the upper turn table and an eccentric angle of the cylinder, and an apparatus abnormality, e.g., the eccentric angle of the cylinder, i.e., a deviation of a center of the cylinder can be detected during machining of the workpiece, thereby suppressing degradation of quality of the workpiece. Furthermore, this can be realized at low costs by just adding a simple function to an existing apparatus.

The machining apparatus for a workpiece can be a double-side polishing apparatus or a double-side lapping apparatus.

Such an apparatus can be preferably adapted to a manufacturing process of a workpiece such as a silicon wafer which requires high flatness in particular.

It is preferable for the control apparatus to include a recording medium in which the relative height position of the upper turn table and the angle formed between the rotational axis of the upper turn table and the longitudinal axis of the cylinder when the upper turn table has moved down to the fixed position in a state where the workpiece is normally held in the holding hole of the carrier are previously recorded as reference values.

With such an arrangement, the workpiece holding abnormality or the deviation of the center of the cylinder can be easily and accurately determined by us in the recorded reference value.

In addition to this, it is preferable for the control apparatus to calculate at least one of the relative height position of the upper turn table and the angle formed between the rotational axis of the upper turn table and the longitudinal axis of the cylinder when the upper turn table has moved down to the fixed position, and to determine a workpiece holding abnormality when a difference between the calculated value and the reference value exceeds a threshold value.

With such an arrangement, the workpiece holding abnormality can be automatically detected in a shorter time.

In addition to this, it is preferable for the control apparatus to calculate at least one of the relative height position of the upper turn table and the angle formed between the rotational axis of the upper turn table and the longitudinal axis of the cylinder during machining of the workpiece, and to determine an apparatus abnormality when a difference between the calculated value and the reference value exceeds a threshold value.

With such an arrangement, the eccentric angle of the cylinder can be always automatically detected during machining of the workpiece.

Effect of the Invention

The machining apparatus for workpiece according to the present invention can calculate the relative height position of the upper turn table and the angle formed between the rotational axis of the upper turn table and the longitudinal axis of the cylinder from the height positions of the surface of the horizontal plate measured by the displacement sensors. Therefore, a holding abnormality of the workpiece can be accurately detected in a short time at low costs before machining the workpiece to avoid damage to the workpiece or the machining apparatus, and an apparatus abnormality such as a deviation of the center of the cylinder can be constantly detected during machining of the workpiece, thereby suppressing degradation of quality of the workpiece.

BEST MODE(S) FOR CARRYING OUT THE INVENTION

Although an embodiment of the present invention will now be described hereinafter, the present invention is not restricted thereto.

To solve the above-described problem, i.e., realizing both detection of a holding abnormality of a workpiece before start of machining and detection of a deviation of a center of a cylinder during machining at low costs, the present inventors have conducted examinations. Consequently, they have discovered that a height position of an upper turn table and/or an eccentric angle of the cylinder could be monitored to detect the holding abnormality of the workpiece, and that providing three or more displacement sensors which measure height positions of a surface of a horizontal plate fixed to the cylinder enables obtaining both the relative height position of the upper turn table and the eccentric angle of the cylinder in real time during machining of the workpiece at low costs, thereby bringing the present invention to completion.

The machining apparatus for a workpiece according to the present invention will now be described in detail. The machining apparatus according to the present invention is configured to insert a thin-plate workpiece such as a silicon wafer into a holding hole of a carrier arranged on a lower turn table, hold it, move down an upper turn table to a fixed position so that the carrier holding the workpiece is sandwiched between the upper turn table and the lower turn table, and simultaneously machine both sides of the workpiece while rotating the upper and lower turn tables around their rotational axis, and there is, e.g., a double-side polishing apparatus or a double-side lapping apparatus. Here, the double-side polishing apparatus will be taken as an example and described with reference to FIG. 1.

Figure 1:
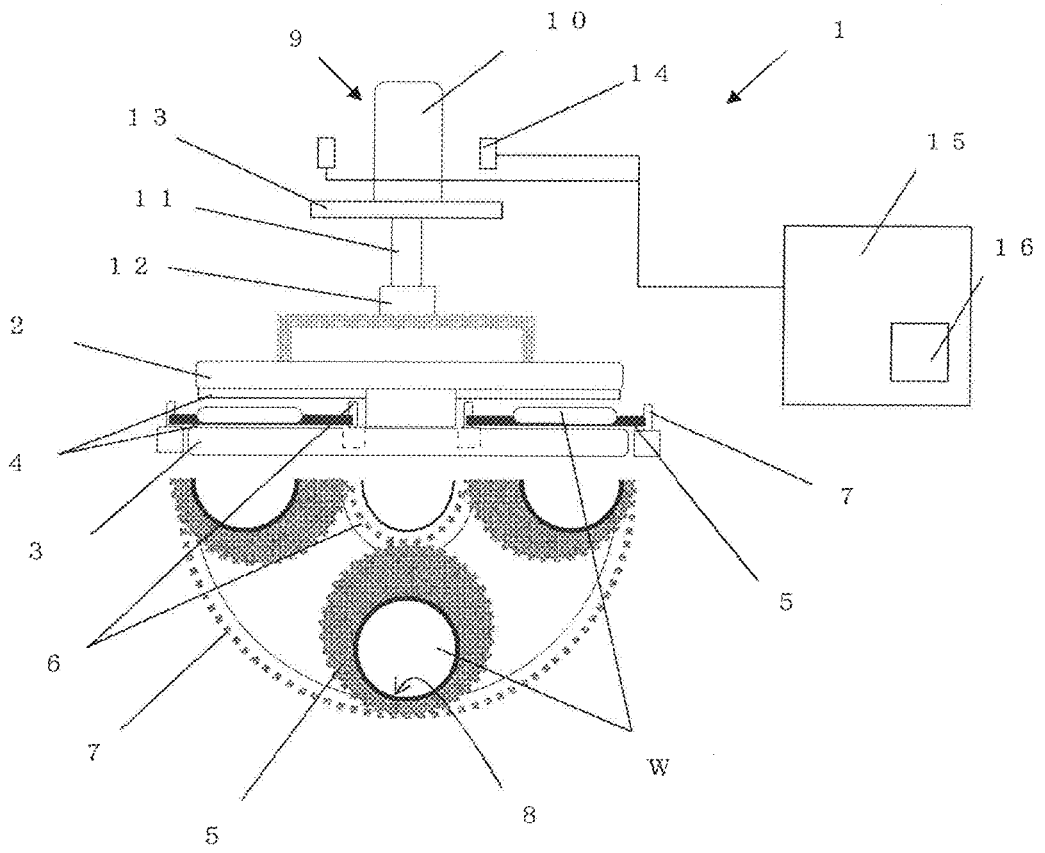
FIG. 1 is a schematic view showing a double-side polishing apparatus as an example of a machining apparatus according to the present invention.

As shown in FIG. 1, the double-side polishing apparatus 1 according to the present invention includes an upper turn table 2 and a lower turn table 3 provided to vertically face each other, and polishing pads 4 are attached to the turn tables 2 and 3, respectively. A sun gear 6 is provided at a central portion between the upper turn table 2 and the lower turn table 3, and an internal gear 7 is provided at a circumferential portion. A holding hole 8 in which a workpiece W is held is formed in each carrier 5. At the time of double-side polishing, the carrier 5 holds the workpiece W in the holding hole 8, and is arranged between the upper turn table 2 and the lower turn table 3 in this state.

Although the workplace W can be manually held in the carrier 5 by an operator, a robot arm which carries the workpiece W to the holding hole 8 of the carrier 5 and inserts it into the holding hole 8 may be provided.

Outer peripheral teeth of each carrier 5 mesh with respective teeth portions of the sun gear 6 and the internal gear 7, and the carrier 5 revolves around the sun gear 6 while rotating on its own axis when the upper turn table 2 and the lower turn table 3 are rotated by a non-illustrated drive source. At this time, both sides of the workpiece W held in the holding hole 8 of the carrier 5 are simultaneously polished by the upper and lower polishing pads 4. At the time of polishing the workpiece, polishing slurry is supplied from a non-illustrated nozzle onto polishing surfaces of the workpiece via a plurality of through holes provided in the upper turn table 2.

The upper turn table 2 is supported by an upper turn table support mechanism 9 from above to be vertically movable. The upper turn table support mechanism 9 has a cylinder 10 extending along a rotational axis direction of the upper turn table 2. A shaft 11 extending downward along the rotational axis direction of the upper turn table 2 is coupled with a lower end of the cylinder 10, and a lower end of the shaft 11 is coupled with a connecting section 12. The upper turn table support mechanism 9 supports the upper turn table 2 from above through this connecting section 12. A height position of the upper turn table 2 can be accurately controlled by upward and downward movements of the shaft 11 of the cylinder 10.

Moving down the upper turn table 2 by the upper turn table support mechanism 9 and sandwiching the carriers 5 each holding the workpiece W between the upper turn table 2 and the lower turn table 3 can applying a polishing load to the carriers 5 and the workpieces W. At this time, when a height position of the upper turn table 2 is controlled, the polishing load applied to the workpieces W and the carriers 5 can be adjusted. The height position of the upper turn table 2 which enables obtaining a desired polishing load is determined as a fixed position, and the upper turn table 2 is moved down to the same fixed position each time in polishing.

Figure 2:
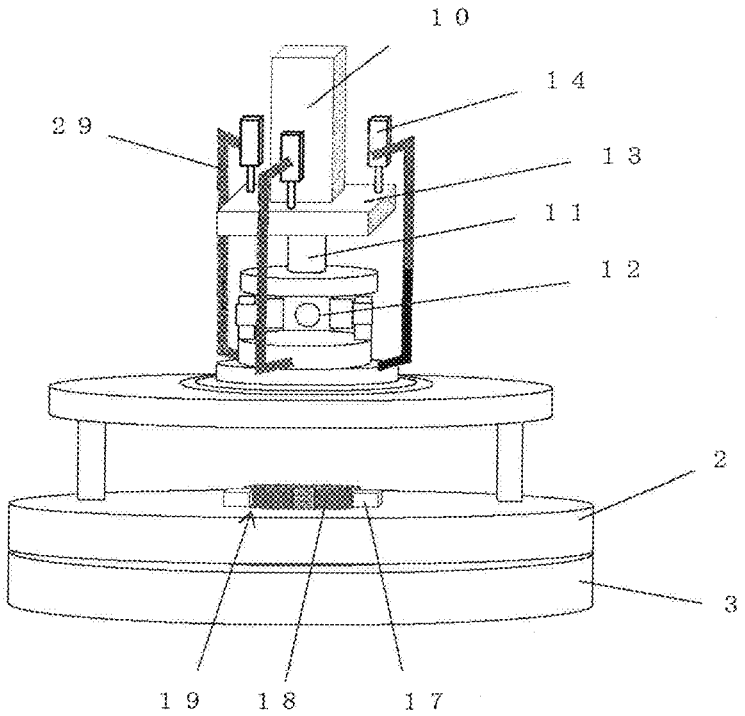
FIG. 2 is a schematic view when an upper turn table of the double-side polishing apparatus according to the present invention has moved down to a fixed position.
Figure 3:
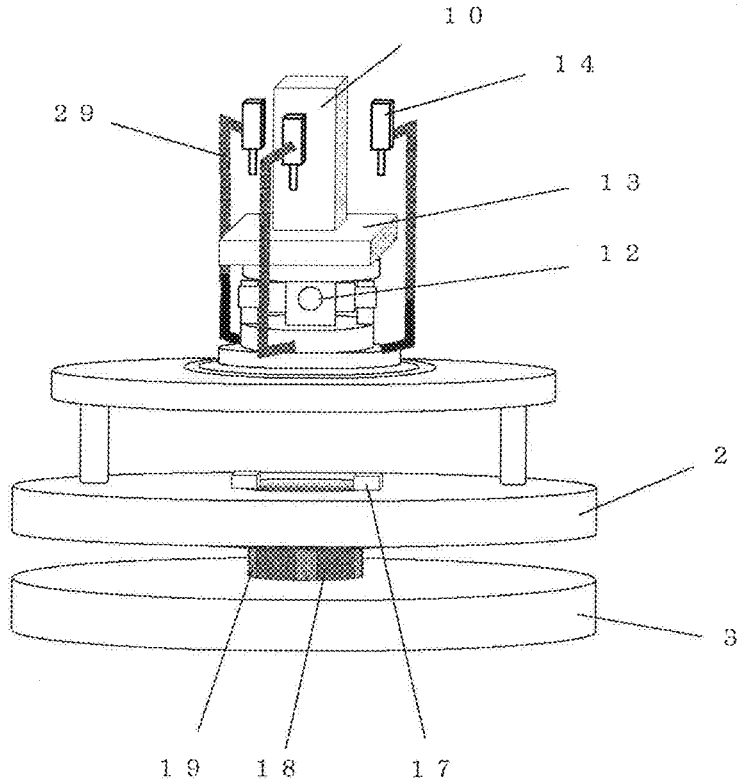
FIG. 3 is a schematic view when the upper turn table of the double-side polishing apparatus according to the present invention has moved up.

As the connecting section 12, for example, a universal joint or a spherical bearing can be used. Consequently, even if thicknesses of the workpieces W or the carriers vary, a degree of freedom can be imparted to an inclination of the upper turn table during the polishing to assuredly transmit the load to the workpieces W. FIGS. 2 and 3 show an example where the universal joint is used for the connecting section 12.

As shown in FIG. 2, when the upper turn table 2 has moved down to the fixed position, a hook 17 disposed to the upper turn table 2 is inserted and fitted in a groove 19 provided in a center drum 18. In this state, rotational drive force of the center drum 18 can be transmitted to the upper turn table 2 to rotate the upper turn table 2. On the other hand, as shown in FIG. 3, when the upper turn table 2 has moved up from the fixed position, the hook 17 is removed from the groove 19.

As shown in FIG. 1, a horizontal plate 13 is fixed to the cylinder 10, and a main surface of the horizontal plate 13 is perpendicular to a longitudinal axis of the cylinder 10. At least three displacement sensors 14 are provided above the horizontal plate 13, and these displacement sensors 14 enable measuring height positions of the surface of the horizontal plate 13 when the upper turn table 2 has moved down to the fixed position, i.e., when the workpieces W are held in the carriers 5 and then the carriers 5 are sandwiched between the upper turn table 2 and the lower turn table 3, and furthermore during machining of the workpieces.

Although the displacement sensors 14 are not restricted in particular, as shown in FIGS. 2 and 3, they can be arranged so that they are held at tips of arms 29 extending upward from a lower side of the connecting section 12. Consequently, it is possible to suppress a measurement accuracy of the displacement sensors 14 from being affected by an eccentric angle of the cylinder 10. In this case, since the displacement sensors 14 also move up and down with the upward and downward movements of the upper turn table 2, lengths of the arms 29 are adjusted so that distances between the displacement sensors 14 and the surface of the horizontal plate 13 when the upper turn table 2 has moved down to the fixed position can have desired values.

In the example shown in FIGS. 2 and 3, as described above, a main body of the cylinder 10 and the horizontal plate 13 do not move up and down, but the shaft 11 of the cylinder 10 moves up and down to vertically move the upper turn table 2. In this case, the displacement sensors 14 may be contact type sensors. Specifically, a configuration is made so that lower ends of the displacement sensors 14 come into contact with the surface of the horizontal plate 13 when the upper turn table 2 has moved down to the fixed position. At this time, a relative height position of the upper turn table 2 can be calculated on the basis of measured height positions of the surface of the horizontal plate 13 and a distance for which the shaft 11 has been actually moved down. Alternatively, as the relative height position of the upper turn table 2, the measured height positions of the surface of the horizontal plate 13 can be used.

When the horizontal plate 13 is configured to move up and down together with the shaft 11 of the cylinder 10, the displacement sensors 14 may be contactless type sensors.

Moreover, an angle formed between the rotational axis of the upper turn table 2 and the longitudinal axis of the cylinder 10 (the eccentric angle of the cylinder 10) can be calculated from three or more height positions of the surface of the horizontal plate 13 measured by the three or more displacement sensors 14.

The machining apparatus according to the present invention does not directly measure the height position of the upper turn table 2 or the eccentric angle of the cylinder 10, but it can calculate both the relative height position of the upper turn table 2 and the eccentric angle of the cylinder 10 from the height positions of the surface of the horizontal plate 13 measured by the three or more displacement sensors 14, thereby enabling monitoring them during machining of the workpieces W. Additionally, such a machining apparatus has a simple configuration at low costs, the displacement sensors 14 are not restricted to both the contact type and the contactless type, and a degree of freedom of design is high.

The relative height position of the upper turn table 2 and the eccentric angle of the cylinder 10 can be calculated by a control apparatus 15. As shown in FIG. 1, the control apparatus 15 is connected to each of the displacement sensors 14, receives measured height positions of the surface of the horizontal plate 13 from the displacement sensors 14, can calculate the relative height position of the upper turn table 2 and the eccentric angle of the cylinder 10, and can provide them to an operator.

If the number of the displacement sensors 14 is three, the effect of the present invention can be sufficiently exerted, but four or more, e.g., six displacement sensors 14 may be provided to further improve the measurement accuracy.

The control apparatus 15 has a recording medium 15 which previously records, as respective reference values, relative height position of the upper turn table 2 and the eccentric angle of the cylinder 10 when the upper turn table 2 has been moved down to the fixed position in a state where the workpieces W are normally held in the holding holes 8 of the carriers 5, respectively. Here, it is preferable to record the reference value of the eccentric angle of the cylinder 10 after the center of the cylinder 10 is sufficiently adjusted so that the rotational axis of the upper turn table 2 actually coincides with the longitudinal axis of the cylinder 10.

Figure 6:
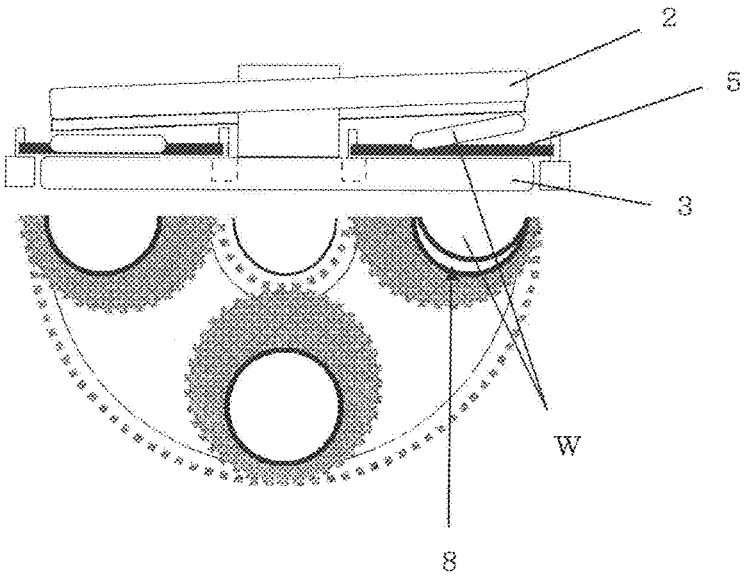
FIG. 6 is a schematic view for explaining a state where a workpiece protrudes from a holding hole of a carrier in the double-side polishing apparatus according to the present invention.

Comprising these respective recorded reference values with actual measurement values enables determining presence/absence of a workpiece holding abnormality or an apparatus abnormality. For example, as shown on FIG. 6, in the double-sided polishing apparatus, in a case where the workpiece W is not correctly accommodated in the holding hole 8 of the carriers 5, when the upper turn table 2 has moved down to the fixed position before starting polishing, the upper turn table 2 can move down only to a position higher than that in a case where the workpiece W is correctly accommodated in the holding hole 8 of the carriers 5 the when only some of the plurality of workpieces W are correctly accommodated in the holding holes of the carriers 5, an inclination of the upper turn table 2 causes an increase in eccentric angle of the cylinder 10. Thus, confirming whether the relative height position of the upper turn table 2 is higher than the reference value or whether the eccentric angle of the cylinder 10 larger than the reference value enables determining presence/absence of a workpiece holding abnormality.

Figure 5:
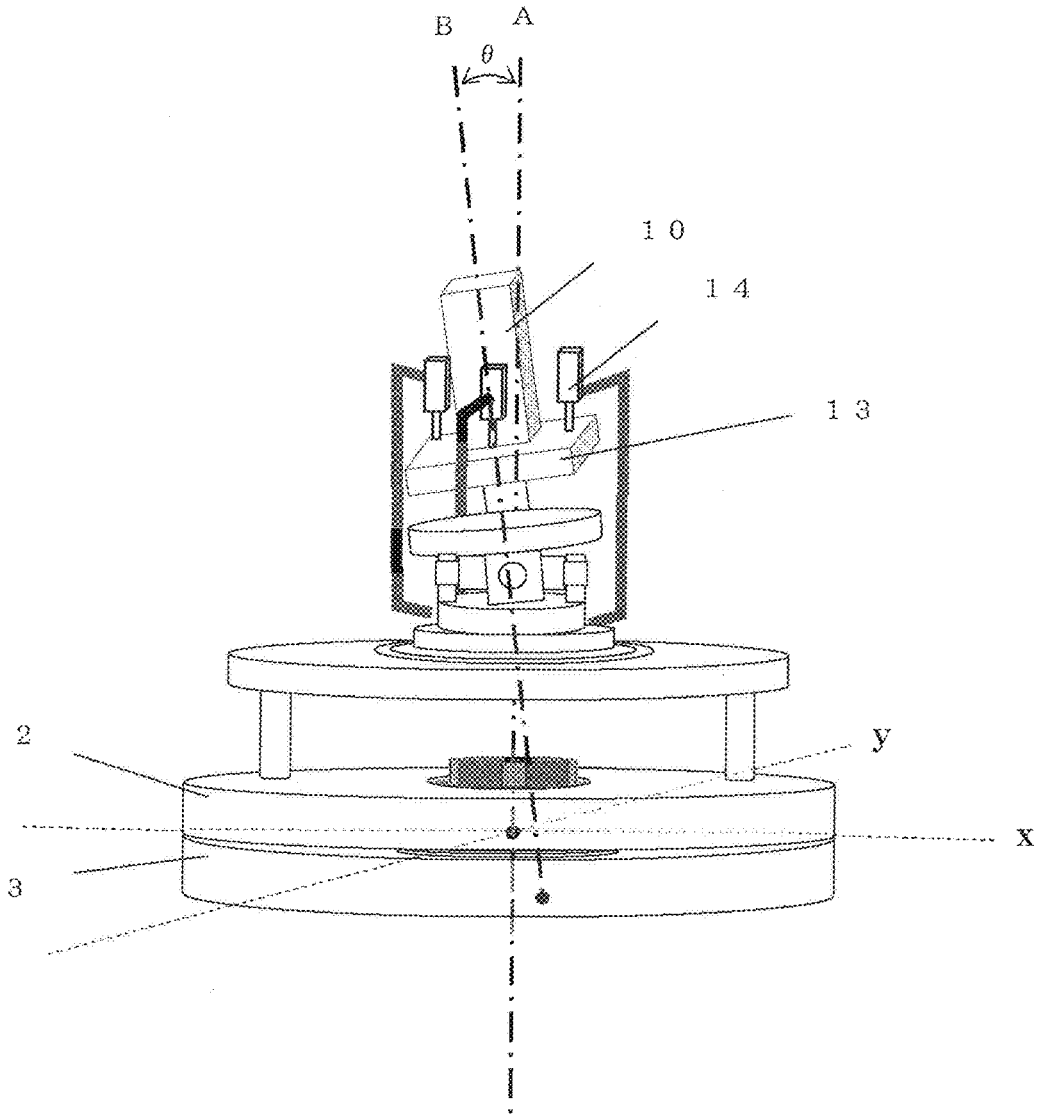
FIG. 5 is a view for explaining an eccentric angle of a cylinder in the double-side polishing apparatus according to the present invention.

More specifically, when the upper turn table 2 has moved down to the fixed position, at least one of the relative height position of the upper turn table 2 and the eccentric angle of the cylinder 10, i.e., an angle θ formed between a rotational axis A of the upper turn table 2 and a longitudinal axis B of the cylinder 10 as shown in FIG. 5 is calculated, and the workpiece holding abnormality is determined when a difference between the calculated value and the reference value exceeds a threshold value. Furthermore, at least one of the relative height position of the upper turn table 2 and the eccentric angle θ of the cylinder 10 is calculated during machining of the workpiece W, and the apparatus abnormality is determined when a difference between the calculated value and the reference value exceeds a threshold value. The control apparatus 15 can automatically perform these calculations and determinations.

The threshold values used for determining the abnormalities can be determined on the basis of, e.g., differences between the relative height position of the upper turn table 2 and the eccentric angle of the cylinder 10 which are actually measured in case of occurrence of an abnormality, and the reference values. Incorporating a program which automatically trips an alarm at the time of exceeding the threshold values into the control apparatus 15, an automatic self-diagnosis function can be realized.

It is to be noted that the angle θ shown in FIG. 5 is emphasized to clarify the explanation, but the angle θ is actually small, and its change cannot be visually grasped.

Although the double-side polishing apparatus has been described above as an example of the machining apparatus according to the present invention, the machining apparatus can be also adapted to a double-side lapping apparatus, and the same effects as those described above can be exerted.

Figure 4:
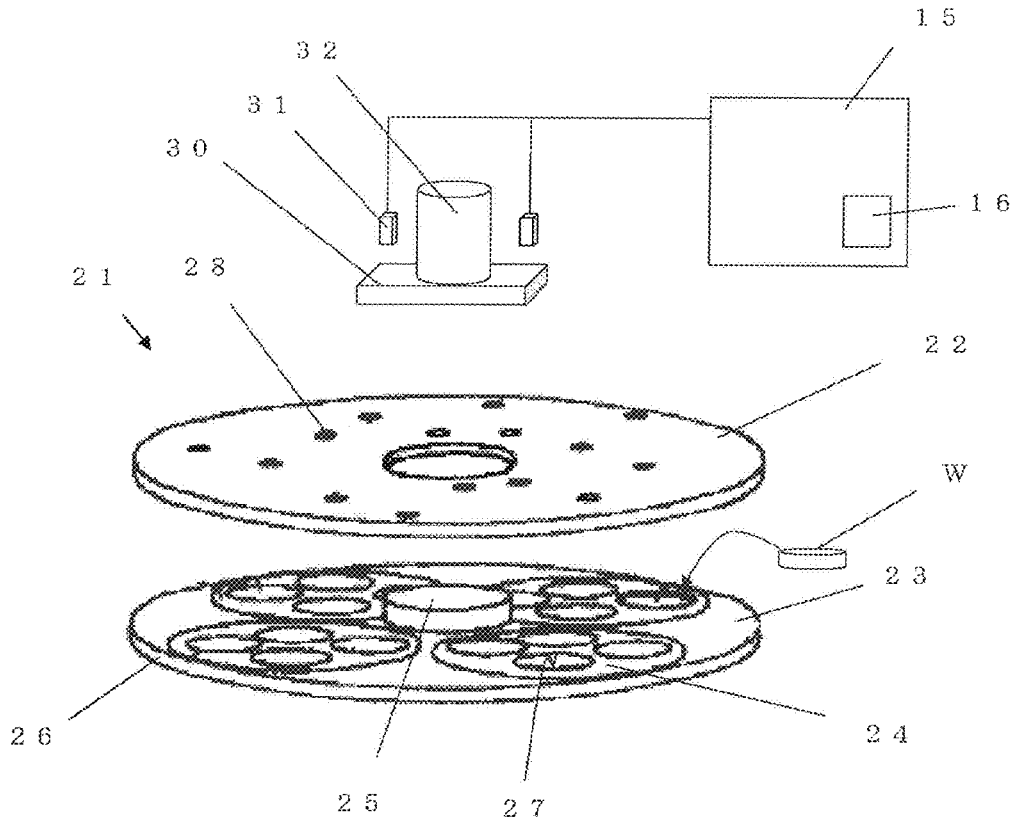
FIG. 4 is a schematic view showing a double-side lapping apparatus as an example of the machining apparatus according to the present invention.

FIG. 4 is a double-side lapping apparatus according to the present invention. As shown in FIG. 4, the double-side lapping apparatus 21 has upper and lower turn tables 22 and 23 (lapping turn tables) provided to face each other in a vertical direction. The lower turn table 23 has a sun gear 25 on an upper surface at a central portion thereof, and has an annular internal gear 26 provided at a circumferential portion thereof. Further, a gear portion which meshes with the sun gear 25 and the is gear 26 is formed on an outer peripheral surface of each carrier 24 which holds workpieces W, thereby providing a gear structure as a whole.

A plurality of holding holes 27 are provided in each carrier 24. The workpieces W to be lapped are inserted into and held in the holding holes 27, respectively. Each carrier 24 is sandwiched between the upper and lower turn tables 22 and 23, and performs planetary gear motion, i.e., rotation and revolution when the lower turn table 23 rotates. At this time, slurry is supplied between the workpieces W and the upper and lower turn tables 22 and 23 via through holes 28 provided in the upper turn table 22 from a nozzle, and both sides of the workpieces W are lapped.

Like the description of the double-side polishing apparatus, the double-side lapping apparatus 21 has a horizontal plate 30 fixed to a cylinder 32 of an upper turn table support mechanism which supports the upper turn table 22 from above to be vertically movable, three or more displacement sensors 31 which measure height positions of a surface of the horizontal plate 30, and a control apparatus 15 connected to each of the displacement sensors 31. Although not shown in FIG. 4, the cylinder 32 is connected to the upper turn table 22 through a connecting section. A relative height position of the upper turn table 22 and an eccentric angle of the cylinder 32 can be calculated by the control apparatus 15 from height positions of a surface of the horizontal plate 30 measured by the displacement sensors 31.

The machining apparatus for a workpiece according to the present invention described above can constantly monitor a height position of the upper turn table and an inclination of the cylinder, prevent damage to the workpieces or the machining apparatus due to a workpiece holding abnormality, or detect an apparatus abnormality by grasping a static accuracy of the upper turn table, thereby suppressing degradation of the quality of the workpieces. Consequently, costs for replacement of materials/components due to damage to the workpieces, polishing pads, and the carriers can be decreased, and an operation outage time of the machining apparatus can be reduced. Consequently, manufacturing costs and productivity can be greatly improved.

EXAMPLES

Although the present invention will now be specifically described with reference to an example and a comparative example of the present invention, the present invention is not restricted thereto.

Example

Double-side polishing of a silicon wafer having a diameter of 300 mm was repeatedly performed by using a machining apparatus (a double-side polishing apparatus) for a workpiece according to the present invention shown in FIG. 1. The double-side polishing apparatus has a total of five carriers each having one holding hole. At this time, detection of a wafer holding abnormality before starting polishing and monitoring of an apparatus accuracy during the polishing were carried out.

In the double-side polishing apparatus, three contact type displacement sensors (manufactured by Keyence Corporation: GT-H10) were provided above a horizontal plate so as to keep uniform distances, respectively. As shown in FIG. 2, height positions of the displacement sensors were adjusted in such a manner that they do not come into contact with a surface of the horizontal plate in a state where an upper turn table has moved up but they come into contact with the surface of the horizontal plate in a state where the upper turn table has moved down to a fixed position.

(Detection of Holding Abnormality)

Figure 7:
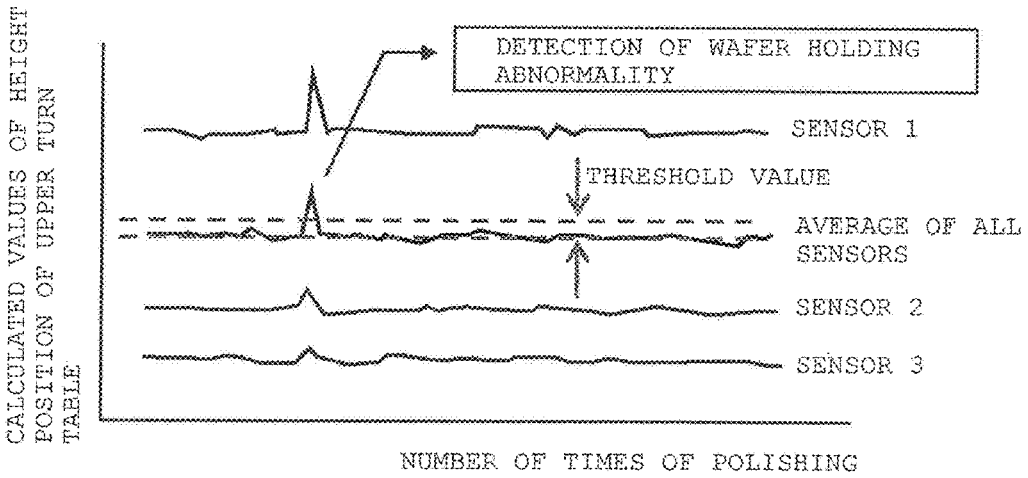
FIG. 7 is a graph showing a change in height position of the upper turn table when a holding abnormality of a wafer has been detected in Example.

A program, which automatically calculates a relative height position of the upper turn table and an eccentric angle of a cylinder when the upper turn table has moved down to the fixed position, determines a holding abnormality if the calculated values exceed respective threshold values, and requests to again hold a wafer, was incorporated in a control apparatus. The relative height position of the upper turn table was determined to be an average value or three calculated values. The threshold values were determined on the basis of the relative height position of the upper turn table when the upper turn table was to be moved down to the fixed position in a state where the wafer is intentionally protruded from the holding hole of the carrier. Although the workpieces or the carriers were damaged due to wafer holding abnormalities which occurred several times a month in conventional examples, all the holding abnormalities were detected by the present invention. FIG. 7 shows calculated values of positions of the upper turn table when a wafer holding abnormality has occurred.

(Monitoring of Apparatus Accuracy)

Figure 8:
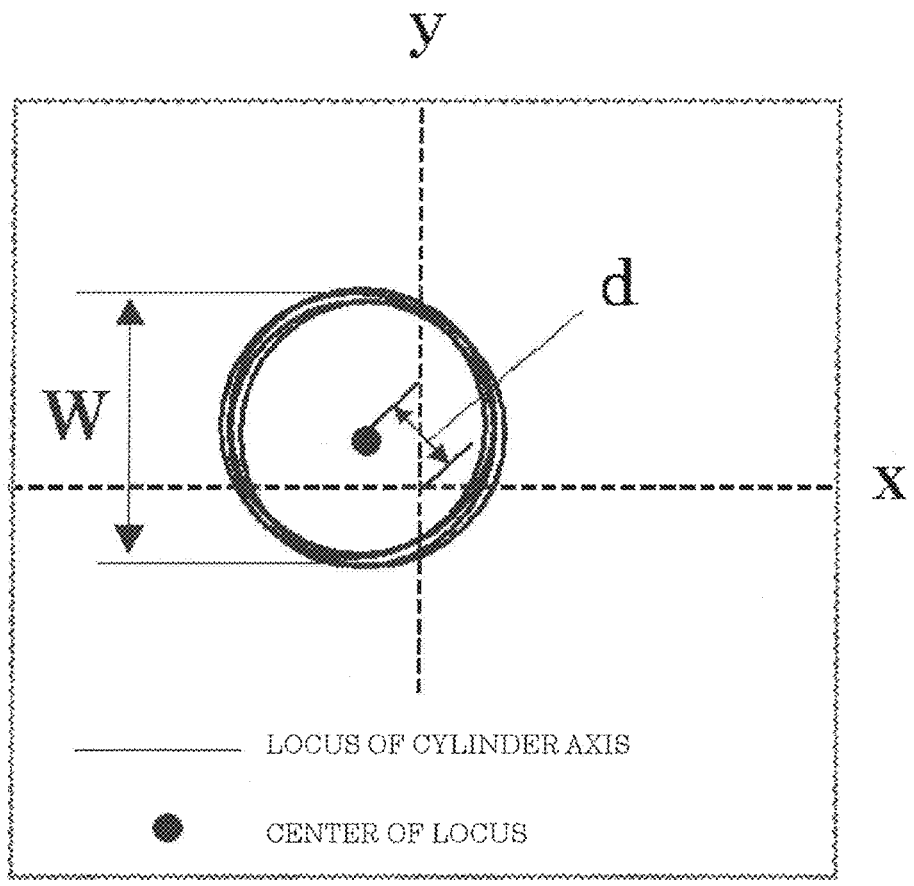
FIG. 8 is a view for explaining an eccentric amount and a misalignment amount defined in Example.

An eccentric angle of the cylinder was calculated during polishing a position on a polishing surface which the longitudinal axis of the cylinder indicated was calculated from the calculated eccentric angle of the cylinder. As shown in FIG. 8, a maximum width W of a locus of the axis of the cylinder on the polishing surface was defined as an eccentric amount, and a distance d from a rotational axis of the upper turn table to the center of the locus was defined as a misalignment amount. Characters of x and y shown in FIG. 8 represent x and y directions shown in FIG. 5, respectively. Monitoring the eccentric amount and the misalignment amount during the polishing enabled quantitatively monitoring behavior and a centering accuracy of the upper turn table. Consequently, it was possible to quickly determine whether a cause of a fluctuation in quality of the wafer was the apparatus accuracy. Management values were imparted to the eccentric amount and the misalignment amount respectively, and a program which trips an alarm indicative of degradation in apparatus accuracy when the management values are exceeded was incorporated in a control apparatus. An accuracy of the apparatus was adjusted when this alarm was tripped. As a result, flatness (SFQRmax) of the wafer was improved 3%.

It is to be noted that the present invention is not restricted to the foregoing embodiment. The foregoing embodiment is just an illustrative example, and any example which has substantially the same configuration and exerts the same functions and effects as the technical concept described in claims of the present invention is included in the technical scope of the present invention.

The invention claimed is:

1. A machining apparatus for a workpiece which inserts a workpiece into a holding hole of a carrier arranged on a lower turn table, holds the workpiece, moves down an upper turn table to a fixed position to sandwich the carrier holding the workpiece between the upper turn table and the lower turn table, and simultaneously machines both sides of the workpiece while rotating the upper turn table and the lower turn table around a rotational axis, respectively, the apparatus comprising:

an upper turn table support mechanism which supports the upper turn table from above to be vertically movable by a cylinder extending along a rotational axis direction of the upper turn table;

a horizontal plate fixed to the cylinder so that a main surface thereof becomes perpendicular to a longitudinal axis of the cylinder;

at least three displacement sensors which measure height positions of a surface of the horizontal plate when the upper turn table has moved down to the fixed position; and a control apparatus configured to calculate a relative height position of the upper turn table and an angle formed between the rotational axis of the upper turn table and the longitudinal axis of the cylinder from the height positions of the surface of the horizontal plate measured by the displacement sensors.

2. The machining apparatus for a workpiece according to claim 1, wherein the machining apparatus for a workpiece is a double-side polishing apparatus or a double-side lapping apparatus.

3. The machining apparatus for a workpiece according to claim 1, wherein the control apparatus comprises a recording medium in which the relative height position of the upper turn table and the angle formed between the rotational axis of the upper turn table and the longitudinal axis of the cylinder when the upper turn table has moved down to the fixed position in a state where the workpiece is normally held in the holding hole of the carrier are previously recorded as reference values.

4. The machining apparatus for a workpiece according to claim 2, wherein the control apparatus comprises a recording medium in which the relative height position of the upper turn table and the angle formed between the rotational axis of the upper turn table and the longitudinal axis of the cylinder when the upper turn table has moved down to the fixed position in a state where the workpiece is normally held in the holding hole of the carrier are previously recorded as reference values.

5. The machining apparatus for a workpiece according to claim 3, wherein the control apparatus calculates at least one of the relative height position of the upper turn table and the angle formed between the rotational axis of the upper turn table and the longitudinal axis of the cylinder when the upper turn table has moved down to the fixed position, and determines a workpiece holding abnormality when a difference between the calculated value and the reference value exceeds a threshold value.

6. The machining apparatus for a workpiece according to claim 4, wherein the control apparatus calculates at least one of the relative height position of the upper turn table and the angle formed between the rotational axis of the upper turn table and the longitudinal axis of the cylinder when the upper turn table has moved down to the fixed position, and determines a workpiece holding abnormality when a difference between the calculated value and the reference value exceeds a threshold value.

7. The machining apparatus for a workpiece according to claim 3, wherein the control apparatus calculates at least one of the relative height position of the upper turn table and the angle formed between the rotational axis of the upper turn table and the longitudinal axis of the cylinder during machining of the workpiece, and determines an apparatus abnormality when a difference between the calculated value and the reference value exceeds a threshold value.

8. The machining apparatus for a workpiece according to claim 4, wherein the control apparatus calculates at least one of the relative height position of the upper turn table and the angle formed between the rotational axis of the upper turn table and the longitudinal axis of the cylinder during machining of the workpiece, and determines an apparatus abnormality when a difference between the calculated value and the reference value exceeds a threshold value.

9. The machining apparatus for a workpiece according to claim 5, wherein the control apparatus calculates at least one of the relative height position of the upper turn table and the angle formed between the rotational axis of the upper turn table and the longitudinal axis of the cylinder during machining of the workpiece, and determines an apparatus abnormality when a difference between the calculated value and the reference value exceeds a threshold value.

10. The machining apparatus for a workpiece according to claim 6, wherein the control apparatus calculates at least one of the relative height position of the upper turn table and the angle formed between the rotational axis of the upper turn table and the longitudinal axis of the cylinder during machining of the workpiece, and determines an apparatus abnormality when a difference between the calculated value and the reference value exceeds a threshold value.

* * * * *